United States Patent [19]

Ward et al.

[11] Patent Number: 4,949,608

[45] Date of Patent: Aug. 21, 1990

[54] COMBINED WEB-CUTTING AND SHEET STACKING APPARATUS

[75] Inventors: Donald J. Ward, Sayre; Gerald R. Bradley, Athens, both of Pa.

[73] Assignee: Paxar Corporation, Pearl River, N.Y.

[21] Appl. No.: 273,470

[22] Filed: Nov. 17, 1988

[51] Int. Cl.[5] ..... B26D 7/32; B65H 29/40; B65H 35/08

[52] U.S. Cl. ..... 83/96; 83/94; 83/156; 83/162; 83/348; 271/176

[58] Field of Search ..... 83/349, 925 A, 94, 155, 83/86, 298, 369, 93, 96, 343, 348, 283, 162, 156; 271/176, 311, 119, 188, 209, 307, 311; 198/855, 785, 750; 414/794.8

[56] References Cited

U.S. PATENT DOCUMENTS

| | | | |
|---|---|---|---|
| 1,471,372 | 10/1923 | Winkley | 83/94 |
| 2,458,612 | 1/1949 | Luzzatto et al. | 83/283 |
| 3,632,107 | 1/1972 | Rehm et al. | 271/188 |
| 3,692,304 | 9/1972 | de Ridder | 271/212 |
| 3,722,336 | 3/1973 | Sarring | 83/925 A |
| 3,830,121 | 8/1974 | Makeev et al. | 83/94 |
| 4,067,568 | 1/1978 | Irvine | 271/176 |
| 4,186,633 | 2/1980 | Baumann et al. | 83/155 |
| 4,362,076 | 12/1982 | Sasaki et al. | 83/349 |
| 4,429,602 | 2/1984 | Vits | 83/96 |
| 4,510,833 | 4/1985 | Uozumi | 83/283 |

*Primary Examiner*—Hien H. Phan
*Assistant Examiner*—Hwei-Siu Payer
*Attorney, Agent, or Firm*—Brooks Haidt Haffner & Delahunty

[57] ABSTRACT

Apparatus for cutting a continuously fed web into sheets and for vertically stacking such sheets. The apparatus receives the web between a pair of cutting knives, one of which is periodically rotatable by a motor periodically connected thereto by a pulse fed electrical clutch, and the resulting sheets are conveyed to a vertical stacker by a plurality of laterally spaced conveyor belts driven by the motor. The stacker has a pair of sheet receiving uprights adjustable toward and away from each other and which are mounted on an adjustable stop for engaging the leading edges of the sheets. The stop and the uprights are adjustable in angle with respect to the vertical. A roller below the stack has either crown portions beneath the belt or non-circular portions between pairs of belts to urge the sheets into the stack. Stripping fingers are between pairs of belts for removing the sheets from the belts. To prevent throwing of the sheets, a hold-down roller engages the web adjacent to where it is cut.

10 Claims, 4 Drawing Sheets

COMBINED WEB-CUTTING AND SHEET STACKING APPARATUS

BACKGROUND OF THE INVENTION

This invention relates to apparatus for cutting a continuously travelling web of paper fabric, etc. into sheets, labels, tags, etc. of predetermined size and for stacking such sheets, etc.

Apparatus for cutting a continuously travelling web into separate items, such as sheets, labels, tags, etc. (hereinafter sometimes collectively identified as "sheets") are well known in the art. Similarly, it is known in the art to vertically stack such items as they are bottom fed to the stack. See, for example, U.S. Pats. Nos. 3,601,265; 3,671,034; 3,834,290; 4,067,568 and 4,384,782.

When the web bears spaced areas of printing, it is desirable to have a stand alone machine to which the web, which is continuously fed to the printing machine, can be continuously fed and which will cut the web intermediate the printed areas and stack the resulting separate sheets. Cutting and stacking machines which can perform such functions are known in the art, but have several disadvantages.

In prior art machines, the design of the cutting knife was such that when the material of the web is changed, e.g. from card stack to fabric, it was necessary to change the entire knife assembly which is time consuming and unacceptable.

In prior art machines, the sheets, which are horizontal when cut, are conveyed by belts to stripping fingers where the sheets are tipped so that the major surfaces thereof extend vertically, and the sheets are collected in a horizontally extending stack. The stripper finger assembly was intended to slide, as the stack grew larger, under the pressure of the sheets, but with tags and depending upon the size and shape of the tags, the stripper finger assembly did not always function properly with such pressure so that the stack would tip or move sideways causing the tags to become out of order.

In addition, such horizontal stacking increased the horizontal size of the machine and required a longer stacking tray for the same quantity of sheets than is required with vertical stacking.

Also, in prior art machines and with tags, the rotation of the knife would cause "throwing" of the tags, and it was necessary to use catch rollers positioned in accordance with the tag length. Accordingly, when the length of the tag changed, it was necessary to reposition the catch rollers, and the size and location of the horizontal stacking apparatus was such that a simple hold-down roller could not be used.

BRIEF SUMMARY OF THE INVENTION

It is an object of the invention to provide a stand-alone web cutting and stacking machine of relatively small size which can be used to cut a continuously moving web of various materials into sheets, tags, labels, etc. and which does not have the aforementioned disadvantages of prior art machines.

In accordance with the preferred embodiment of the invention, the cutting and stacking machine has an entrance end at which there are a pair of opposed and easily removable and replaceable cutting blades, one of the blades being non-rotatable and the other of the blades being periodically rotatable by clutch means operable by an electrical synchronizing signal synchronized with the printing of the web. As the web is cut into sheets by the blades, they are held down by a hold-down roller and engage the upper surfaces of a plurality of laterally spaced and continuously driven conveyor belts which transport the sheets horizontally to stripping fingers and a stop from which they move into the bottom of a vertical stacking unit which is adjustable in size and in inclination with respect to the vertical. Preferably, the movement of the sheets into the bottom of the stack is assisted by spaced driven rollers beneath the stacking unit.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

DETAILED DESCRIPTION OF THE INVENTION

The invention will be described in connection with the cutting of a continuous web at locations between printed areas thereon to provide separate sheets with the printing thereon and with the stacking of such sheets. It will be apparent, however, that the apparatus of the invention has other uses, such as, for the cutting and stacking of sheets without printing thereon.

Figure 1:
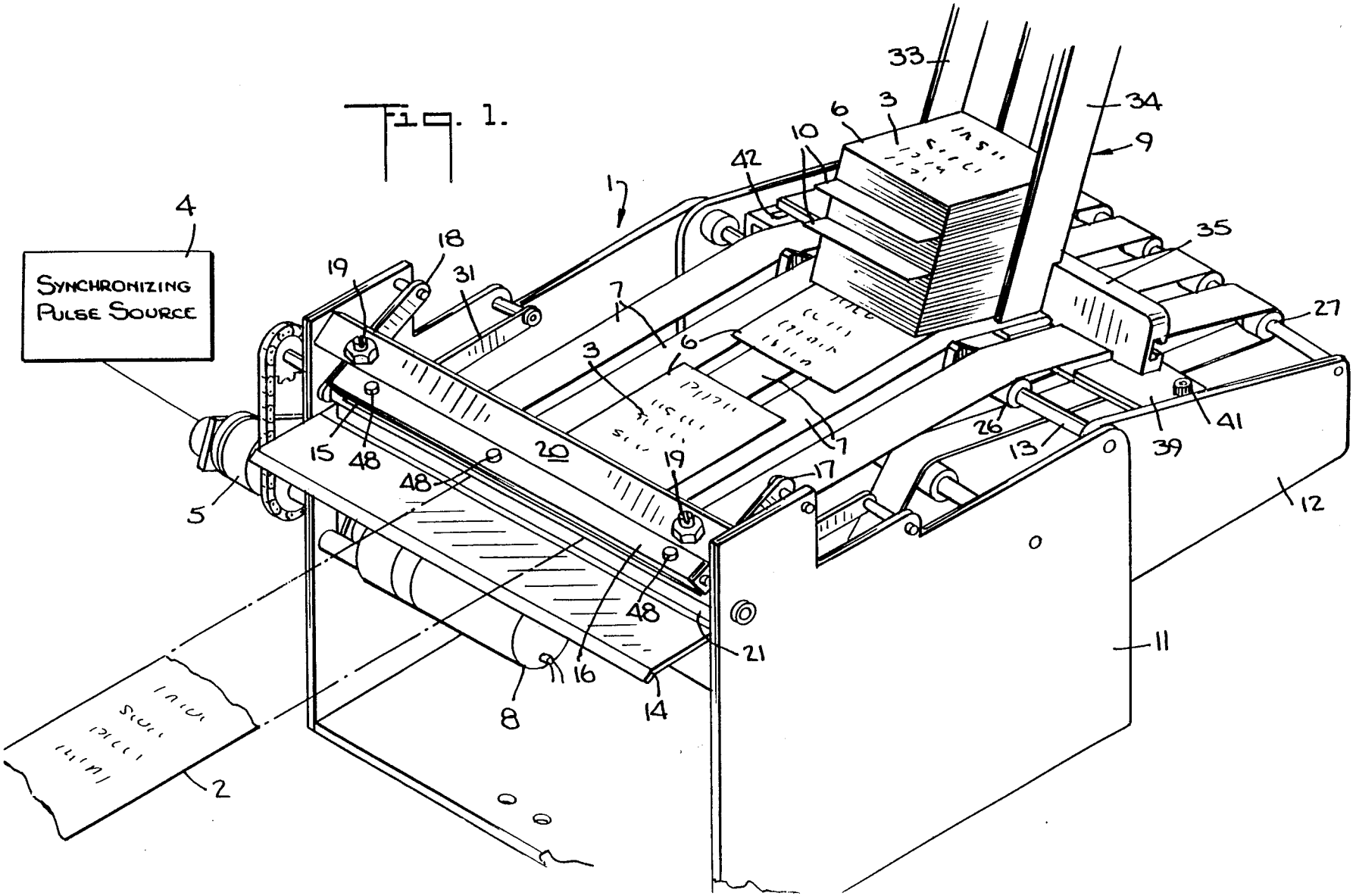
FIG. 1 is a perspective view of the apparatus of the invention.

FIG. 1 illustrates the cutting and stacking apparatus 1 of the invention receiving a web 2, such as a web of paper, fabric, plastic or pressure sensitive material having spaced printed areas 3. The web 2 is printed in advance of the apparatus 1 by any conventional web printing machine (not shown), such as a Model 640 thermo transfer printer sold by Fasco Labelling Systems, Sayre, Pa., which has, or has installed thereon, a conventional synchronizing electrical pulse source 4 which controls a known type of electrically operable clutch 5 so that the cutting knife or blade, hereinafter described, will make one revolution when the synchronizing pulse is received by the clutch 5 and cause the knife to cut the web 2 intermediate the printed areas 3, thereby cutting the web 2 into individual sheets, tags or labels 6 as the web 2 is advanced.

The sheets 6 are carried by continuously moving, flexible conveyor belts 7 which are driven in a conventional manner by an electric motor 8. The belts 7 can, for example, be made of flexible polypropylene. While five belts 7 are shown, preferably the number thereof is seven with the two outer belts having a width twice the width of the intermediate belts to permit the use of a greater number of stripping fingers and to provide improved control. For example, the two outer belts 7 may have a width of $\frac{3}{4}$ in. and the five intermediate belts may have a width of $\frac{3}{8}$ in. It will be noted that the belts 7 are laterally spaced apart for purposes hereinafter described.

The sheets 6 are fed by the belts 7 to a bottom stacking unit 9 where they are stacked vertically. To separate quantities of the sheets 6 or of sheets 6 with different printing thereon, flags 10 may be inserted automatically in the stack of sheets 6 as required. Thus, by delaying the pulse delivered by the source 4 to the clutch 5, or omitting a pulse, a longer sheet or label will be cut which acts as a batch separator.

The components of the apparatus of the invention are mounted on a stationary or fixed frame 11 and a pivotable frame 12, the frame 12 being pivotable around the axis of a stacker shaft 13 for purposes hereinafter described.

The web 2 enters the apparatus 1 on top of a fixed plate 14 which is secured to the frame 11 and passes between a nonrotating knife or blade 15 mounted on a frame 16 which is pivotally secured to the frame 11 by means of the arms 17 and 18, downward movement of the frame 16 being limited by adjusting screws 19 on a cross piece 20. The frame 16 and the blade 15 is urged downwardly by springs (not shown). A rotatable knife or blade 21, rotatable by the clutch 5 as described hereinbefore, is rotatably mounted on the frame 11 below the web 2.

Figure 2:
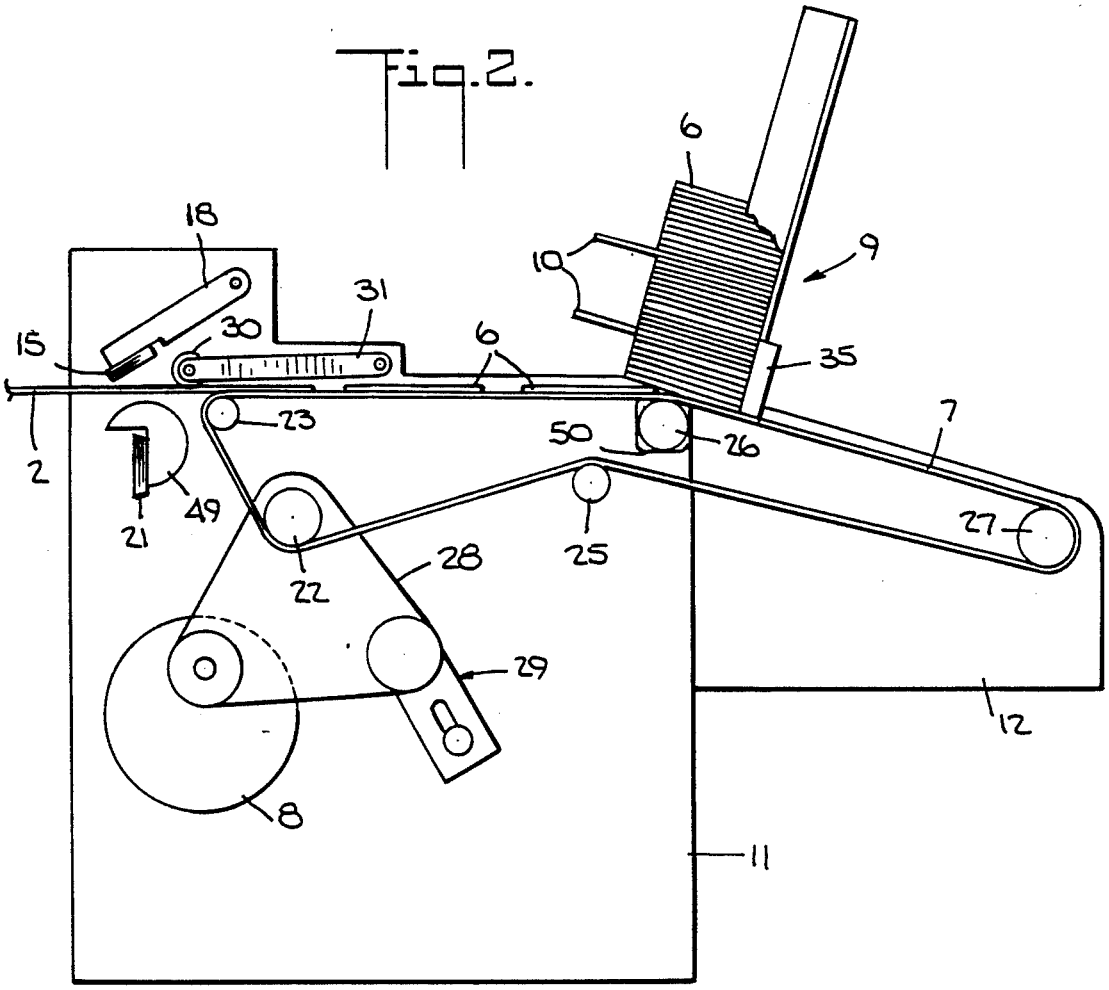
FIG. 2 is a side elevation view of the apparatus shown in FIG. 1 with one side of the supporting frame and the pivotable frame removed for illustration purposes.

Referring now to FIG. 2, the belts 7 engage a plurality of rollers 22–27, the roller 22 being driven by the motor 8 by means of a belt 28 which extends around a belt tensioner 29 and the roller 22. A hold-down roller 30 engages the upper surface of the web 2 and is mounted on a pair of arms, only one of which, 31, is shown, which are pivotally secured to the frame 11. Roller 30 is urged downwardly by gravity.

Figure 5:
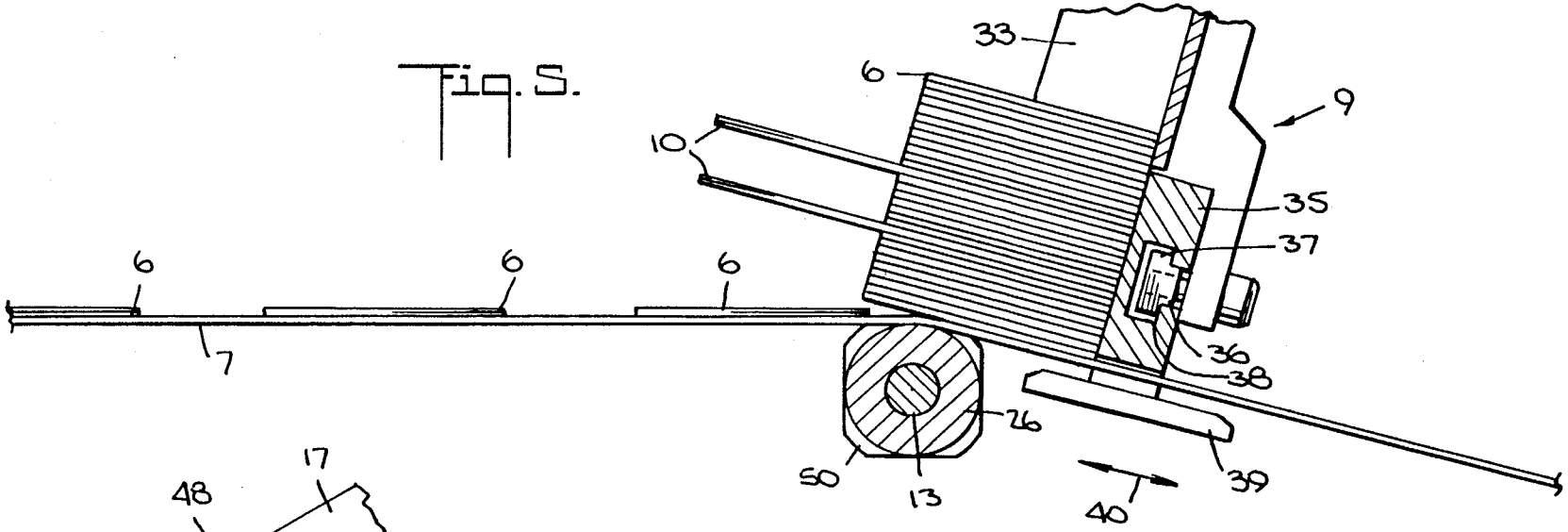
FIGS. 5 and 6 are enlarged, side elevation views of the stacker forming part of the apparatus of the invention.
Figure 6:
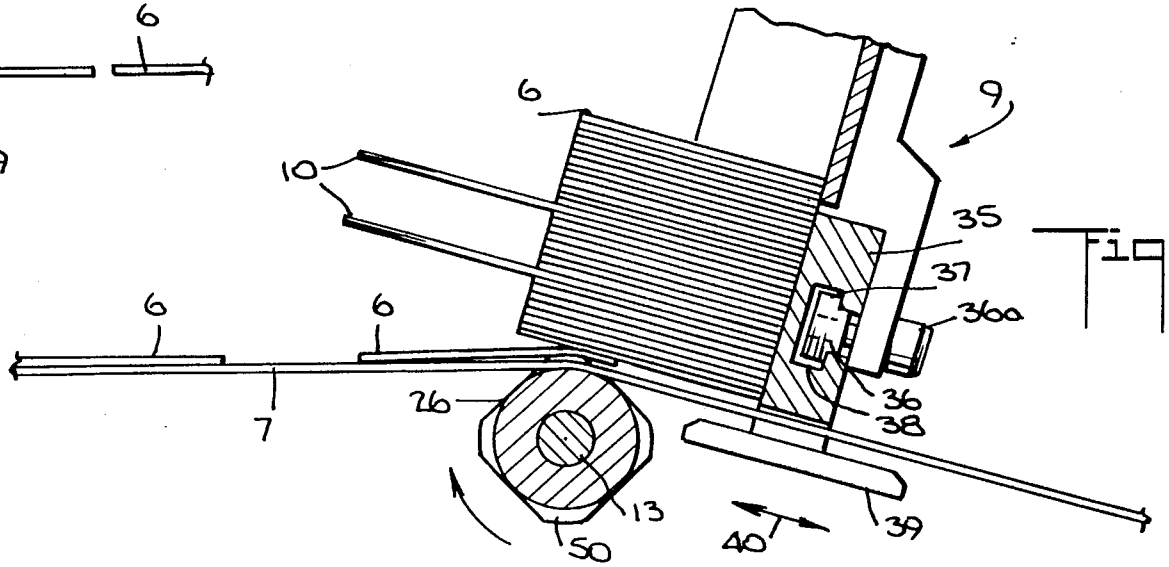

The stacking unit 9 (see FIGS. 1 and 5–8) comprises a pair of metal uprights 33 and 34 which are adjustably mounted on a stop 35, such as by T-nuts 36 engaging bolts **36*a* and having their heads 37 received in a T-slot 38 in the stop 35 (see FIGS. 5 and 6). Thus, by means of the nuts 36, the spacing of the uprights 33 and 34 can be adjusted to accommodate sheets 6** of various widths.

The stop 35 is secured at its ends to a plate 39 which is adjustable in the directions indicated by the double-ended arrow 40 (see FIGS. 5 and 6) so as to accommodate sheets 6 of various lengths. The plate is secured to the frame 12 by bolts, such as the bolt 41 (see FIG. 1) received in slots, such as the slot 42, to permit such adjustment of the plate 39 and hence, the stop 35. The stop 35 in combination with the angle of the frame 12, hereinafter described, are normally selected so that about $\frac{1}{2}$ to $\frac{1}{4}$ inch of the lowermost sheet 6 of stack of sheets 6 extends at an angle, which is adjustable, over the next sheet 6 arriving at the stacker unit 9 and to be stacked.

The plate 39 also has a plurality of fingers, such as the fingers 43 (see FIG. 7), which extend between the conveyor belts 7 for stripping the sheets 6 from the belts 7. The fingers 43 also support the stack of sheets 6.

Figure 3:
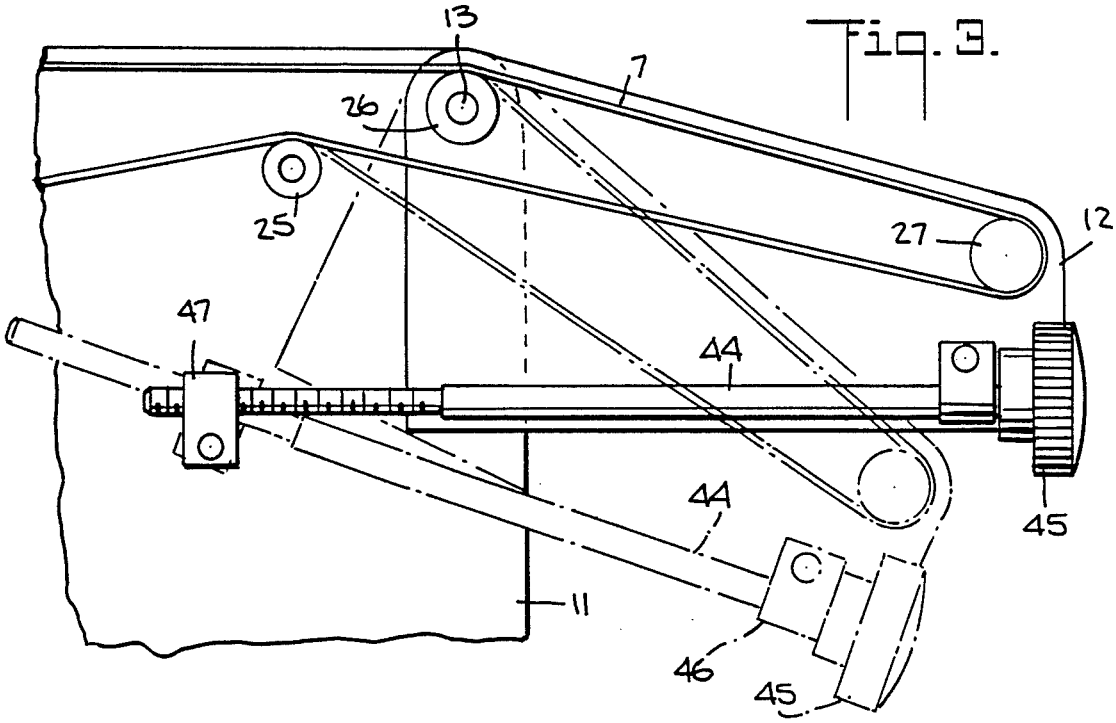
FIG. 3 is an enlarged, side elevation view of a portion of the apparatus shown in the preceding figures and illustrates the device for changing the angle of portions of the conveyor belts.

To permit the use of various materials for the web 2, and hence, the sheets 6, the frame 12 is adjustable with respect to the angle thereof in relation to the plane of the belts 7 in advance of the shaft 13. For example, such angle may be variable from 10° to approximately 30°. FIG. 3 illustrates the apparatus for adjusting such angle.

As previously mentioned, the frame 12 is pivotable about the axis of the shaft 13. The position of the frame 12 is maintained and is adjustable by means of the rotatable screw 44 which has a manually rotatable knob 45. The screw passes through a stop 46 pivotally secured to the frame 12, and the threads thereof engage the threads of a nut 47 pivotally mounted on the fixed frame 11. Thus, by rotation of the screw 44, the angle of the frame 11, and hence, the components mounted thereon, can be adjusted to the desired value. One position of the frame 12, i.e. a small angle, is shown in solid lines in FIG. 3, and a second position of the frame 12, i.e. a larger angle, is shown in dot-dash lines in FIG. 3.

Figure 4:
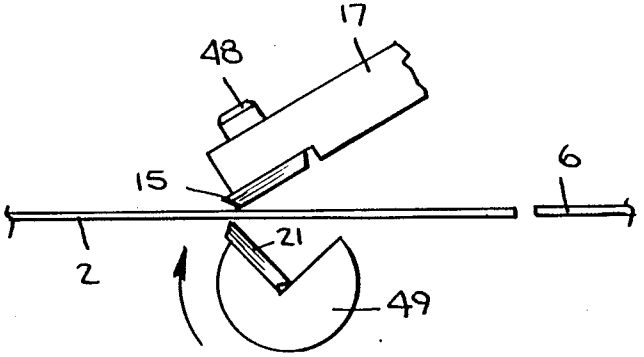
FIG. 4 is an enlarged, side elevation view of the web cutting blades forming part of the apparatus of the invention.

The cutting knives or blades 15 and 21 are illustrated in FIG. 4. The non-rotating knife 15 is mounted on a portion of the frame 16 and secured thereto by screws 48 (see FIGS. 1 and 4). The screws 48 extend through holes in the frame 16 to provide a fixed angle of the knife 15.

The knife 21 is mounted on a rotatable shaft 49 which is intermittently rotated one revolution by the motor 8 through the clutch 5 when the latter receives the synchronizing pulses. When the shaft 49 is rotated, it cuts the web 2 intermediate successive printed areas 3.

Each of the knives 15 and 21 has two cutting edges as shown in FIG. 4, only one edge being used at a time. However, when one cutting edge dulls, a new cutting edge can be provided by merely reversing the knife in an obvious manner.

In a preferred embodiment of the invention, the shaft 13 also carries square rubber discs 50 with rounded corners. The discs 50 are disposed intermediate the belts 7. The radii of the corners is such that when the radius thereof is perpendicular to a belt 7, the corner extends above the belt 7 (see FIG. 6), engages a sheet 6 and pulls the latter into the bottom of the stack of sheets 6. The dimensions of the flats of the discs 50 between the corners are such that the flats are below the tops of the belts 7 (see FIG. 5) as the shaft 13 rotates. Such configuration of the discs 50 also bounces the stack of sheets 6 slightly which aids in sliding a sheet 6 under the stack.

Figure 10:
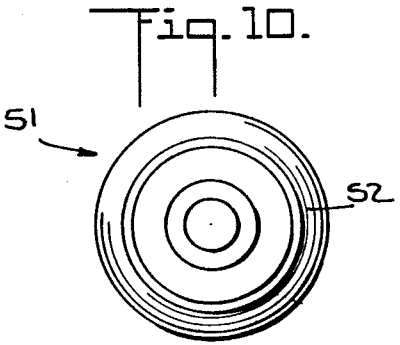
FIGS. 9 and 10 are, respectively, side and end views of an alternative embodiment of a shaft which can be used beneath a stack of sheets.
Figure 9:
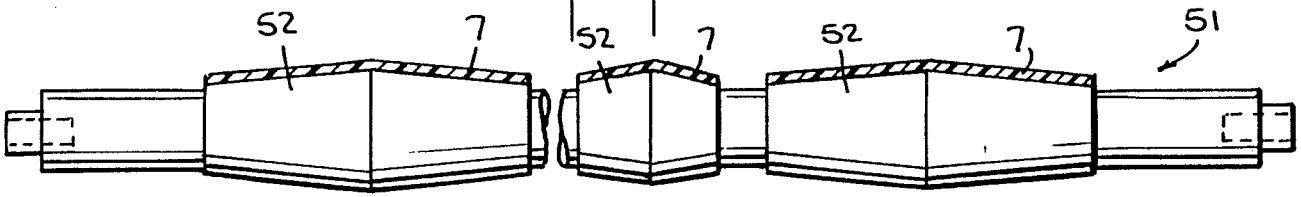
Figure 8:
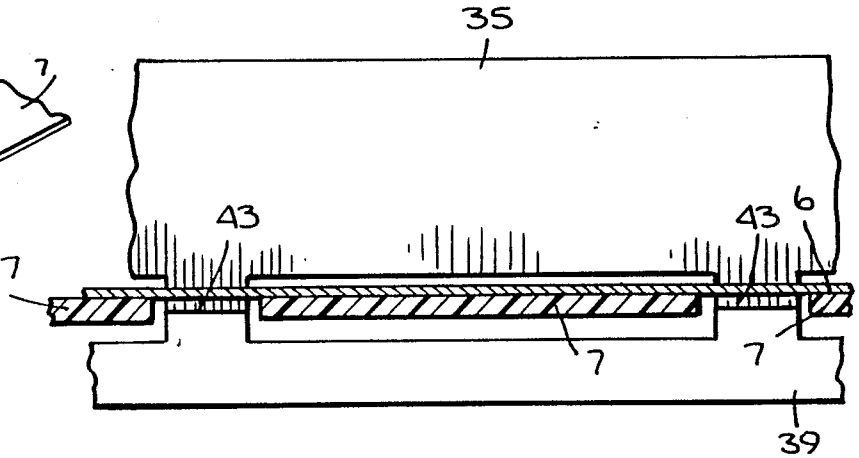
FIGS. 7 and 8 are, respectively, fragmentary perspective and front views, the latter partly in cross-section, of the stop and stripper unit forming part of the apparatus of the invention.
Figure 7:
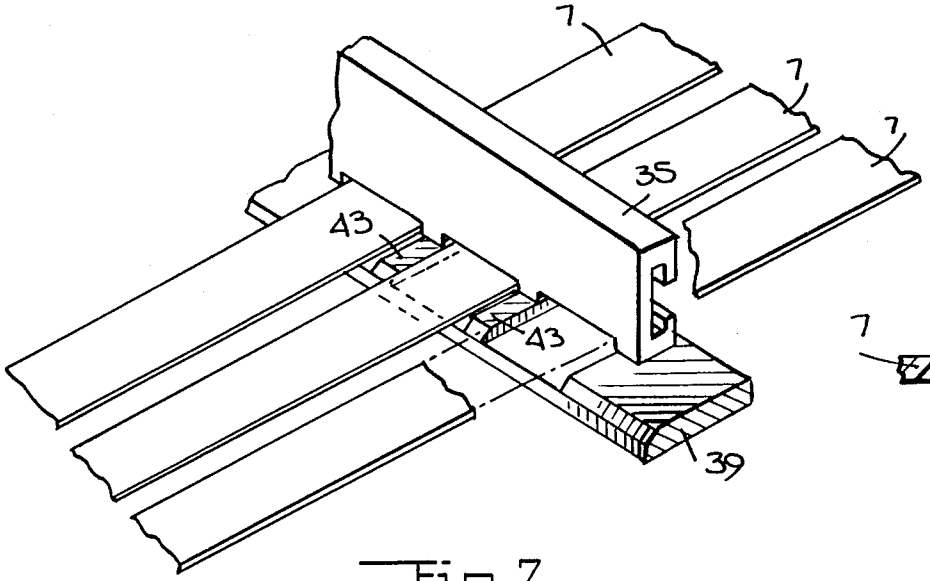

Alternatively, if the material of the web 2 is relatively soft so that it can conform easily to the shape of the conveyor belts 7 as it bends around the roller beneath the stack, the shaft 13 with its cylindrical rollers 26 and the discs 50 can be replaced by a shaft 51 of the type shown in FIGS. 9 and 10 having a plurality of oppositely facing spaced frusto-conical sections 52 which support the belts 7 as indicated in FIG. 9. Although the shaft 51 shown in FIG. 9 has outer sections of greater axial length than the intermediate sections as used in the preferred embodiment, the outer sections can be of the same axial length as the intermediate sections when it merely replaces shaft 13.

In operation, the web 2 is fed to the printing machine (not shown) and then to the conveyor belts 7 between the knives 15 and 21. The spacing between the printer and the knives 15 and 21 and the timing of the synchronizing pulse are selected so that as the web 2 is printed, the knife 21 will cut the web 2 intermediate the printed areas 3. The uprights 33 and 34 are adjusted to correspond to the width of the web 2, and the stop 35 is adjusted so that when a sheet 6 reaches the stop 35, the trailing edge of the bottom sheet 6 will overlie the leading edge of the succeeding sheet 6 by about ¼ to ½ inch. Depending on the nature of the material of the web 2, the angle of the frame 12 is adjusted so that the succeeding sheets 6 will enter the stack below the sheet 6 already in the stack. The printer and conveyor belts 7 are started and the web 2 is cut at the knives 15 and 21 into sheets 6 which are conveyed to the bottom of the stack of sheets 6, each successive sheet raising the stack by the thickness of a sheet 6.

Although preferred embodiments of the present invention have been described and illustrated, it will be apparent to those skilled in the art that various modifications may be made without departing from the principles of the invention.

We claim:

1. Apparatus for cutting a web into separate sheets and stacking such sheets as the web is fed into said apparatus, said apparatus comprising;

a fixed frame;

a plurality of rollers rotatably mounted on said frame with the axes of said rollers substantially parallel to each other and spaced from each other in a predetermined direction, a first one of said rollers being mounted at one end of said frame and a second one of said rollers being mounted at the other end of said frame;

a pivotable frame pivotally mounted on said fixed frame for pivotal movement around the axis of said second roller;

a third roller rotatably mounted on said pivotable frame with its axis spaced from the axis of said second roller in said predetermined direction;

at least three relatively long and narrow, laterally spaced belts disposed in side-by-side relation and mounted on said plurality of rollers and said third roller with their lengths substantially parallel and extending in said predetermined direction for transporting individual sheets from said first roller to said second roller;

motor means connected to said first one of said rollers by a continuous drive for continuously moving the upper surfaces of said belts in said predetermined direction;

a rotatable knife rotatably mounted on said fixed frame with its axis of rotation substantially parallel to the axis of said first roller and mounted in spaced relation to said first roller in the direction opposite to said predetermined direction for engaging and cutting a web as its is fed to said belts;

a non-rotatable knife mounted on said fixed frame in opposition to said rotatable knife for receiving web therebetween;

clutch means connected to said rotatably knife and said motor means for periodically interconnecting said rotatable knife and said motor means and cutting the web at predetermined portions thereof into sheets of predetermined length as the web is fed to said knife means, said belts being disposed to receive the sheets as the web is cut;

stop means adjustably mounted on said pivotable frame intermediate said second roller and said third roller for engaging the sheets at their leading edges as the latter pass said second roller, said stop means being adjustable in position in directions parallel to said predetermined direction;

a pair of uprights adjustably mounted on said stop means for receiving the sheets with their major surfaces substantially horizontal and holding them in a vertical stack, said uprights being adjustable toward and away from each other for receiving sheets of different widths;

stripping fingers below said uprights for removing sheets from said belts and respectively disposed between pairs of said belts; and adjusting means connected to said fixed frame and to said pivotable frame for changing the angular relationship of said pivotable fame to said fixed frame and thereby changing the angle of said uprights to the vertical.

2. Apparatus as set forth in claim 1 wherein said second roller has portions of non-circular cross section intermediate pairs of said belts for engaging the sheets.

3. Apparatus as set forth in claim 1 further comprising a hold-down roller adjacent said rotatable knife and intermediate said rotatable knife and said second roller for engaging said web and restraining sheets cut from the web.

4. Apparatus for cutting a web into separate sheets and stacking such sheets as the web is fed into said apparatus, said apparatus comprising;

a plurality of relatively long and narrow laterally spaced belts disposed in side-by-side relation with their lengths substantially parallel for transporting individual sheets from a first position to a second position;

motor means connected to said belts with a continuous drive for continuously moving the upper surfaces of said belts in the direction from said first position to said second position;

rotatable knife means at said first position for cutting the web;

clutch means connected to said knife means for periodically operating said knife means and cutting the web at predetermined portions thereof into sheets of predetermined length as the web is fed to said knife means, said belts being disposed to receive the sheets as the web is cut;

stop means at said second position and disposed to engage the sheets at their edges as they reach said second position;

sheet stacking means disposed at said second position and above said upper surfaces of said belt for receiving and holding the sheets in vertically stacked relation, said stacking means comprising a pair of vertically extending uprights mounted on said stop means, said uprights being adjustably mounted for movement toward and away from each other and for movement in the length direction of said belts, said stop means being adjustably mounted for movement in the lengthwise direction of said belts, and said stop means being mounted on a fame which is adjustably pivotable around an axis transverse to the length of said belts for tilting said uprights with respect to the vertical;

feeding means at said second position for delivering the sheets to said sheet stacking means and beneath any sheets previously received by said sheet stacking means, said feeding means being disposed below said sheet stacking means.

5. Apparatus as set forth in claim 4 wherein there is a roller mounted on said frame at the side of said stop means opposite from said first position and said belts extend to said roller for adjusting the angle of portions of the upper surfaces of said belts with respect to the remainder thereof.

6. Apparatus for cutting a web into separate sheets and stacking such sheet as the web is fed into said apparatus, said apparatus comprising;

at least three relatively long and narrow, laterally spaced belts disposed in side-by-side relation with their lengths substantially parallel for transporting sheets from a first position to a second position;

motor means connected to said belts for moving the upper surfaces of said belts in the direction from said first position to said second position;

rotatable knife means at said first position for cutting the web;

clutch means connected to said knife means for periodically operating said knife means and cutting the web at predetermined portions thereof into sheets of predetermined length as the web is fed to said knife means, said belts being disposed to receive the sheets as the web is cut;

stop means at said second position and disposed to engage the sheets at their edges as they reach said second position, said stop means being adjustably mounted for movement in the lengthwise direction of said belts;

sheet stacking means disposed at said second position and above said upper surfaces of said belt for receiving and holding the sheets in vertically stacked relation;

feeding means at said second position for delivering the sheets to said sheet stacking means and beneath any sheets previously received by said sheet stacking means, said feeding means being disposed below said sheet stacking means and comprising a plurality of stripping finers secured to said stop means and extending between pairs of said belts for stripping sheets from said belts.

7. Apparatus for cutting a web into separate sheets and stacking such sheets as the web is fed into said apparatus, said apparatus comprising:

at least three relatively long and narrow, laterally spaced belts disposed in side-by-side relation with their lengths substantially parallel for transporting sheets from a first position to a second position;

motor means connected to said belts for moving the upper surfaces of said belts in the direction from said first position to said second position;

rotatable knife means at said first position for cutting the web;

clutch means connected to said knife means for periodically operating said knife means and cutting the web at predetermined portions thereof into sheets of predetermined length as the web is fed to said knife means, said belts being disposed to receive the sheets as the web is cut;

stop means at said second position and disposed to engage the sheets at their edges as they reach said second position;

sheet stacking means disposed at said second position and above said upper surfaces of said belt for receiving and holding the sheets in vertically stacked relation;

feeding means at said second position for delivering the sheets to said sheet stacking means and beneath any sheets previously received by said sheet stacking means, said feeding means being disposed below said sheet stacking means and comprising stripping fingers disposed respectively between pairs of said belts and engageable with the sheets on said belts.

8. Apparatus for cutting a web into separate sheets and stacking such sheets as the web is fed into said apparatus, said apparatus comprising:

at least three relatively long and narrow, laterally spaced belts disposed in side-by-side relation with their lengths substantially parallel for transporting sheets from a first position to a second position; the two outermost belts of said at least three belts having widths greater than the widths of the belt or belts intermediate said two outermost belts;

motor means connected to said belts for moving the upper surfaces of said belts in the direction from said first position to said second position;

rotatable knife means at said first position for cutting the web;

clutch means connected to said knife means for periodically operating said knife means and cutting the web at predetermined portions thereof into sheets of predetermined length as the web is fed to said knife means, said belts being disposed to receive the sheets as the web is cut;

stop means at said second position and disposed to engage the sheets at their edges as they reach said second position;

sheet stacking means disposed at said second position and above said upper surfaces of said belt for receiving and holding the sheets in vertically stacked relation;

feeding means at said second position for delivering the sheets to said sheet stacking means and beneath any sheets previously received by said sheet stacking means, said feeding means being disposed below said sheet stacking means.

9. Apparatus for cutting a web into separate sheet and stacking such sheets as the web is fed into said apparatus, said apparatus comprising:

a plurality of relatively long and narrow, laterally spaced belts disposed in side-by-side relation with their lengths substantially parallel for transporting individual sheets from a first position to a second position;

motor means connected to said belts with a continuous drive for continuously moving the upper surfaces of said belts in the direction from said first position to said second position;

rotatable knife means at said first position for cutting the web;

clutch means connected to said knife means for periodically operating said knife means and cutting the web at predetermined portions thereof into sheets of predetermined length as the web is fed to said knife means, said belts being disposed to receive the sheets as the web is cut;

stop means at said second position and disposed to engage the sheets at their edges as they reach said second position;

sheet stacking means disposed at said second position and above said upper surfaces of said belt for receiving and holding the sheets in vertically stacked relation;

feeding means comprising a plurality of driven rollers respectively beneath said belts at said second position for delivering the sheets to said sheet stacking means and beneath any sheets prreviously received by said sheet stacking means, said feeding means being disposed below said sheet stacking means and each of said rollers decreasing in size from a larger diameter intermediate its axial ends to a smaller diameter at its axial ends.

10. Apparatus for cutting a web into separate sheets and stacking such sheets as the web is fed into said apparatus, said apparatus comprising:

at least three relatively long and narrow, laterally spaced belts disposed in side-by-side relation with their lengths substantially parallel for transporting individual sheets from a first position to a second position;

motor means connected to said belts with a continuous drive for continuously moving the upper surfaces of said belts in the direction from said first position to said second position;

rotatable knife means at said first position for cutting the web;

clutch means connected to said knife means for periodically operating said knife means and cutting the web at predetermined portions thereof into sheets of predetermined length as the web is fed to said knife means, said belts being disposed to receive the sheets as the web is cut;

stop means at said second position and disposed to engage the sheets at their edges as they reach said second position;

sheet stacking means disposed at said second position and above said upper surfaces of said belt for receiving and holding the sheets in vertically stacked relation;

feeding means comprising a plurality of driven rollers at said second position for delivering the sheets to said sheet stacking means and beneath any sheets previously received by said sheet stacking means, said feeding means being disposed below said sheet stacking means and said rollers being respectively between pairs of said belts and have non-circular cross-sections, the portions thereof having the largest diameter being engageable with the sheets on said belts.

* * * * *